United States Patent [19]

Calhoun

[11] 4,331,183

[45] May 25, 1982

[54] WIRE BENDING TOOL

[76] Inventor: Thorval Calhoun, 4532 Eureka St., Las Vegas, Nev. 89103

[21] Appl. No.: 120,622

[22] Filed: Feb. 11, 1980

[51] Int. Cl.[3] ..... B21F 1/00; B21D 7/02

[52] U.S. Cl. ..... 140/106; 72/409

[58] Field of Search ..... 72/409, 459; 140/106, 140/123

[56] References Cited

U.S. PATENT DOCUMENTS

| | | | |
|---|---|---|---|
| 3,360,018 | 12/1967 | Lindsay | 140/106 |
| 3,662,580 | 5/1972 | Power | 72/459 X |
| 3,847,189 | 11/1974 | Guzda | 140/106 |
| 4,091,845 | 5/1978 | Johnson | 140/106 |

OTHER PUBLICATIONS

Sears, 1979-1980, Tools Catalog, Copyright 1979, p. 120.

*Primary Examiner*—Paul A. Bell

*Attorney, Agent, or Firm*—Sellers and Brace

[57] ABSTRACT

A hand held wire bending tool is provided having three handles two of which operate wire gripping jaws while the third is swung through a short arc to form either a right angle or a U-bend in a wire. The tool is particularly useful in providing ceiling suspension wires with loops suitable for supporting a ceiling grid network in a predetermined horizontal plane.

10 Claims, 6 Drawing Figures

WIRE BENDING TOOL

This invention relates to hand tools, and more particularly to an improved simple tool for bending a wire to form a load supporting loop.

BACKGROUND OF THE INVENTION

A variety of wire bending tools have been proposed heretofore including those designed for making either a right angle bend or a U-shaped loop of a predetermined size. These are capable of performing the function for which they are designed but all are deficient in one or more important respects. The following United States patents disclose typical prior proposals, namely, Olhovski U.S. Pat. No. 1,337,616; Varney U.S. Pat. No. 1,666,801; Dyne U.S. Pat. No. 2,625,723; Kuchman et al. U.S. Pat. No. 2,732,744; Swanson U.S. Pat. No. 2,864,272; Small et al. U.S. Pat. No. 3,194,038; Redmon U.S. Pat. No. 3,421,553; Thomas U.S. Pat. No. 3,604,244; Power U.S. Pat. No. 3,662,580; Guzda U.S. Pat. No. 3,847,189 and Johnson U.S. Pat. No. 4,091,845. Stein is illustrative of the deficiencies of prior tools in that he lacks means for firmly gripping wires of different sizes as well as means for bending U-shaped loops of different widths between the loop legs. The same defect is common to most of the other patents listed above. Swanson's tool accommodates wires of different sizes but his tool must be inserted axially of one end of the wire and later withdrawn from the return bend loop by an intricate manoeuvre. Johnson can accommodate wires of different diameters but cannot form loops of different sizes. Moreover his tool has numerous components and lacks satisfactory provision for use with a scanning laser light beam.

SUMMARY OF THE INVENTION

This invention provides a simply constructed economical hand held wire bending tool avoiding the defects and shortcomings of prior tools. Two of the tool's three handles are pivotally interconnected rearwardly of a pair of wire gripping jaws having sets of grooves for gripping wires of different sizes and at different distances from the outer ends of the jaws. The third handle is provided with a yoke pivoted crosswise of the tool jaws and pivotable from a position parallel and closely beside the wire to form either right angle bends or a U-bend at the user's option. A graduated scale or other indicator means carried by the wire bending handle is conveniently positioned for viewing while being traversed by a scanning laser beam when the wire is gripped at a desired predetermined level, thereby enabling the user to bend a multiplicity of ceiling support wires at the same level with precision and maximum convenience.

Accordingly, it is a primary object of the invention to provide a unique hand held wire bending tool.

Another object of the invention is the provision of a simple rugged wire bending tool having three components pivotally interconnected and cooperating to form one or more bends in a wire.

Another object of the invention is the provision of an improved tool for use in bending suspension wires for a ceiling grid assembly with high precision at a predetermined level.

These and other more specific objects will appear upon reading the following specification and claims and upon considering in connection therewith the attached drawing to which they relate.

Referring now to the drawing in which a preferred embodiment of the invention is illustrated:

Figure 4:
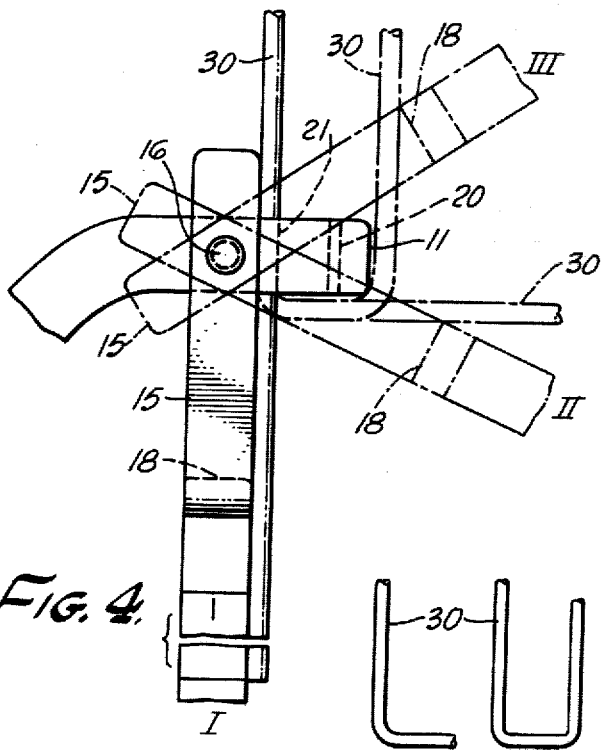
FIG. 4 is a fragmentary elevational view of FIG. 3 and indicating in two sets of dot and dash lines the position of the wire bending handle after completing a right angle bend and after completing a U-bend.
Figure 6:
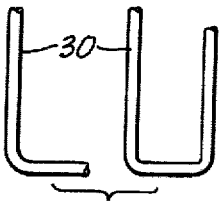
FIG. 6 is a view showing both a right angle bend and a U-bend.
Figure 5:
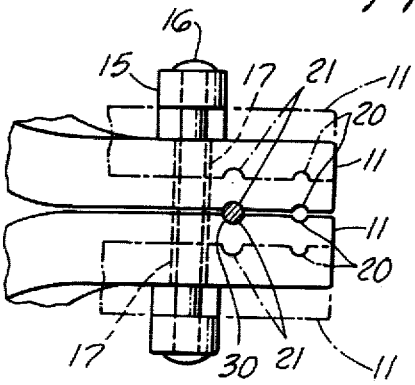
FIG. 5 is a fragmentary top plan view taken across the top of FIG 4.
Figure 3:
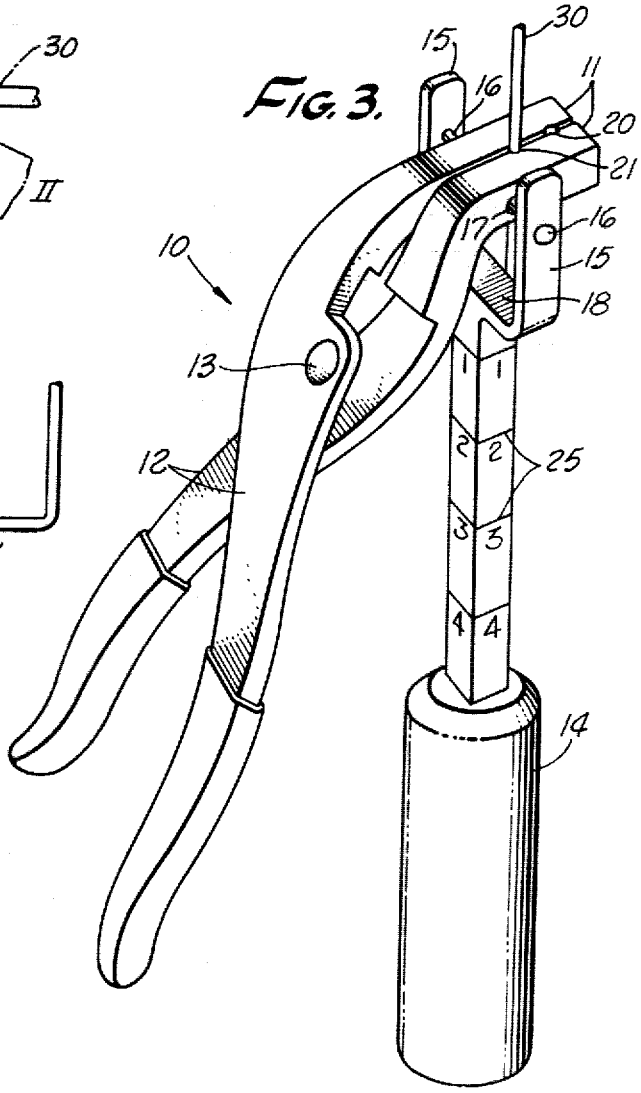
FIG. 3 is a perspective view of the invention wire bending tool gripping a wire to be bent.

Referring to the drawings and more particularly to FIG. 3, there is shown an illustrative embodiment of my wire bending tool designated generally 10. This tool has a pair of wire clamping jaws provided with handles 12, 12 pivotally interconnected at 13. A third handle 14 is equipped with a yoke 15 pivoted to jaws 11, 11 by a shaft 16 having a loose fit through aligned holes 17 extending transversely of the jaws. FIG. 4 makes clear that the bight portion 18 of yoke 15 is located sufficiently from shaft 16 to permit the yoke to pivot freely around the outer end of jaws 11. Jaws 11 preferably are in a plane lying at an acute angle to the plane of handles 12, 12 for the convenience of the operator and to enable him to grip all three handles in close proximity to one another at the beginning of a wire bending operation.

The facing sidewalls of jaws 11, 11 are provided with sets of semi-circular grooves 20, 21 extending transversely thereof the depth of which is preferably slightly less than one half the diameter of the wire to be gripped. This assures a firm grip on the wire when the jaws are closed thereagainst. As herein shown, the sets of grooves 20, 21 are of different sizes to accommodate different gauge wire of the sizes commonly used in the suspension of ceiling grid systems. It will also be noted that the sets of grooves are spaced different distances from the outer ends of the jaws to form U-bends of different widths when the handle is bent to the position indicated by III in FIG. 4. Although only two sets of wire gripping grooves are shown, it will be understood that a greater number may be present each of a different size.

The shank of handle 14 is preferably provided with one or more gauging or indicator marks 25. Desirably, these marks encircle the shank and each is identified with a numeral, a letter or the like symbol to assist the user making a bend in the wire at a desired point in a manner which will be described presently.

Figure 1:
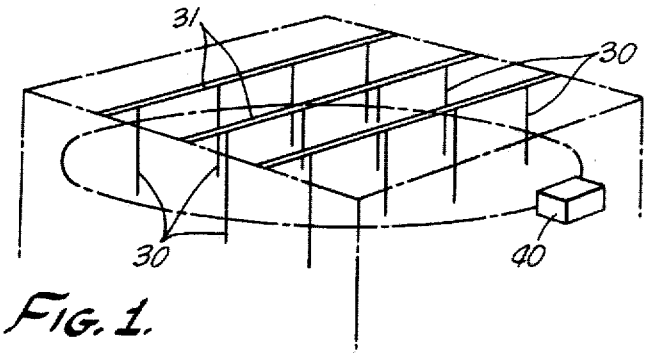
FIG. 1 is a fragmentary diagrammatic perspective view showing the upper portion of a room with a multiplicity of ceiling suspension wires depending from overhead supports with their lower end portions in the path of a laser beam scanning device.
Figure 2:
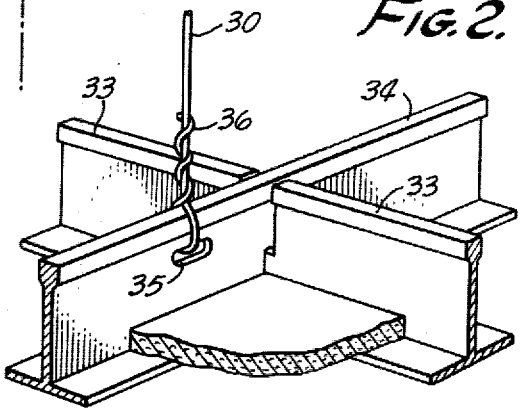
FIG. 2 is a fragmentary perspective view of a portion of a ceiling grid system supported by one of the wires after being formed with a U-bend by the tool of this invention.

Tool 10 is particularly suitable for bending the lower end of the suspension wires for a conventional acoustical ceiling. As shown in FIG. 1, a room to be equipped with such a ceiling is provided with a plurality of suspension wires draped from overhead stringers 31. These wires are employed to suspend T-shaped grid members 33, 34 in a predetermined horizontal plane by the aid of opening 35 through which the hook-equipped ends of suspension wires 30 are threaded and suitably secured as by several convolutions of twisting 36. It is critically important that the hook provided in wires 30 be located in the same horizontal plane.

To assist the workmen in bending the hook or loop at the lower end of the wires in this common plane, a laser beam generating device 40 of known construction is securely mounted on one wall of the room. This device operates in known manner to scan the room with a roving beam of laser light lying in a horizontal plane at a convenient level below the desired plane of the right angled bend to be made in each of the wires 30. Typically and by way of example, device 40 might be positioned to generate a scanning beam intersecting the shank of handle 14 at the indicator mark designated 3 in FIG. 3.

In use, the operator places the scanning device 40 in operation and then grips each of the wires 30, 30 in turn in the appropriate set of grooves 20, 21 and slides the tool along the wire until the scanning beam intersects the vertically disposed handle 14 at the selected indicator mark 3. He then firmly clenches the wire by gripping handles 12, 12 and then pivots handle 14 with his right hand to the position indicated by II if he wishes to make a right angle bend or by pivoting it to the position indicated by III if he wises to form a U-bend or loop. It will be understood that jaws 11, 11 may be equipped with a light spring urging the jaws apart if so desired thereby facilitating release of the tool from the wire at the end of the bending operation.

After each of the wires 30 is provided with a bend of the desired configuration the workman proceeds to install the grid system in known manner with assurance that the entire grid will lie in the same horizontal plane.

While the particular wire bending tool herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A hand-held wire bending tool comprising:

a first handle having a U-shaped yoke at one end thereof;

a plier-like tool having second and third handles pivotally connected together rearwardly of a pair of wire gripping jaws integral with a respective one of said second and third handles and having at least one set of wire gripping grooves extending crosswise of the inner faces thereof; and shaft means extending loosely through each of said jaws between said grooves and said pivot connection of said handles with the ends thereof mounted in a respective one of the legs of said U-shaped yoke whereby said first handle is operable to bend a wire gripped in said grooves through an angle of 90° C.

2. A wire bending tool as defined in claim 1 characterized in that the bight portion of said yoke is positioned to bend a wire about the forward end of said jaws to form a U-shaped bend in a wire gripped between said grooves as said first handle is pivoted forwardly about said wire gripping jaws.

3. A wire bending tool as defined in claim 2 characterized in that said first handle is pivotable through an arc substantially greater than 90° C. from a starting position generally parallel to a wire to be bent and gripped between said jaws.

4. A wire bending tool as defined in claim 3 characterized in that said jaws are provided with a plurality of sets of said wire gripping grooves, the grooves of each set facing one another when said jaws are closed and said sets of grooves being spaced different distances from the outer end of said jaws.

5. A wire bending tool as defined in claim 1 characterized in that said jaws lie in a plane inclined to a plane common to the operating handles of said jaws.

6. A wire bending tool as defined in claim 1 characterized in that said first handle is provided with indicator means spaced from said shaft means and adapted to be traversed by a horizontal light beam when said tool is gripping a ceiling grid suspension wire in readiness to be bent at a predetermined level.

7. A tool for making at least a right angle bend at a predetermined point in a ceiling suspension wire anchored to an overhead support comprising:

a pair of wire gripping jaws each integral with a respective handle pivotally connected together rearwardly of said jaws for pivotal movement toward and away from one another and which handles are adapted to be held in one hand while gripping a wire extending crosswise of said jaws;

a third handle having a yoke at one end straddling said jaws and pivoted thereto on a shaft extending loosely through openings crosswise of each of said jaws between the wire gripping surfaces thereof and the pivot connection between said first mentioned handles; and the jaws of said tool being adapted to grip a suspended wire above but immediately contiguous to said predetermined bending point and with the yoke of said third handle positioned below said jaws and alongside said wire and said third handle and the yoke thereof then being pivotable against said wire and through an arc adequate to form a right angle bend in a gripped wire.

8. A tool as defined in claim 7 characterized in that said third handle is provided with gauging means between the opposite ends thereof to aid the user in bending successive ceiling suspension wires in a common horizontal plane by gripping each wire at a level such that a selected point on said gauging means lies in the path of a laser light beam operating in a selected horizontal plane.

9. A tool as defined in claim 8 characterized in that the wire engaging faces of said jaws are provided with at least one set of grooves extending crosswise thereof and lying generally in the plane through which said third handle pivots.

10. A tool as defined in claim 9 characterized in that said jaws are provided with two sets of grooves spaced different distances from the outer ends thereof, and said third handle being pivotable through an arc adequate to form a right angle bend and a U-bend at the user's option.

* * * * *